US008453572B2

(12) United States Patent
Dryer et al.

(10) Patent No.: US 8,453,572 B2
(45) Date of Patent: Jun. 4, 2013

(54) GUN FIRED PROPELLANT SUPPORT ASSEMBLIES AND METHODS FOR SAME

(75) Inventors: Richard Dryer, Oro Valley, AZ (US); Chris E. Geswender, Green Valley, AZ (US)

(73) Assignee: Raytheon Company, Waltham, MA (US)

( * ) Notice: Subject to any disclaimer, the term of this patent is extended or adjusted under 35 U.S.C. 154(b) by 176 days.

(21) Appl. No.: 12/836,954

(22) Filed: Jul. 15, 2010

(65) Prior Publication Data

US 2012/0012021 A1 Jan. 19, 2012

(51) Int. Cl.
*F42B 15/00* (2006.01)

(52) U.S. Cl.
USPC ..... 102/374; 102/381; 102/490

(58) Field of Classification Search
USPC ..... 102/374, 376, 380, 381, 490, 473
See application file for complete search history.

(56) References Cited

U.S. PATENT DOCUMENTS 1,447,023 A * 2/1923 Kaiser ..... 102/490
3,349,708 A * 10/1967 Paget ..... 102/374
3,355,985 A * 12/1967 Gauss et al. ..... 89/1.816
6,352,218 B1 * 3/2002 Holmqvist et al. ..... 244/3.29
6,421,999 B1 * 7/2002 Lo ..... 60/255
7,800,031 B2 * 9/2010 Rastegar et al. ..... 244/3.22

* cited by examiner

*Primary Examiner* — James Bergin

(74) *Attorney, Agent, or Firm* — Schwegman Lundberg & Woessner, P.A.

(57) ABSTRACT

A gun fired projectile includes a rocket motor housing including a pressure chamber and an exhaust nozzle. A plurality of propellant cells are positioned within the pressure chamber. The rocket motor propellant is mechanically supported during the severe gun fire event. This support may take several forms, each of which is discussed herein. The projectile further includes a support structure including one or more supports: wherein each of the one or more supports is engaged with the rocket motor housing. Each of the one or more supports is engaged with one propellant cell of the plurality of propellant cells, and each of the one or more supports suspends an individual propellant cell from the remainder of the plurality of propellant cells. All of these approaches provide the opportunity to tailor the performance of the rocket motor by combining a combination of propellant formulations and geometries to optimize the projectile performance.

32 Claims, 12 Drawing Sheets

TRIM KEY RIBS TO FORM "SHELVES"

GUN FIRED PROPELLANT SUPPORT ASSEMBLIES AND METHODS FOR SAME

TECHNICAL FIELD

Gun fired projectiles.

BACKGROUND

Extended range, gun fired guided projectiles including rocket motors are subject to failure because of the nature of the rocket motor and the gun fire environment. The enormous stresses including pressures and forces of the gun fire environment accelerate a projectile up to 12,000 g's. These stresses and high temperatures in the environment cause one or more of compression, expansion and possibly fracture of the rocket motor propellant that results in failure of the projectile, sometimes catastrophically.

In one example, where the rocket propellant is subjected to inertial loading from gun firing, corresponding compression forces cause propellant fractures that increase the surface area for burning. The fractured propellant burns in an unpredictable manner and negatively affects the range and accuracy of the projectile. In another example, where the rocket propellant is fractured from inertial based compression forces, the propellant undergoes adiabatic compression and prematurely initiates within the bore of a gun thereby causing a catastrophic failure of the projectile and gun.

In still another example, the high temperature environment in the gun barrel causes the rocket propellant to expand and fill a limited space. Subsequent ignition of the rocket propellant in the limited space creates unexpected high pressures within the projectile that unpredictably increase the burn rate of the propellant. Unpredictable burning of the propellant negatively affects the flight of the projectile including its range and accuracy.

SUMMARY

In accordance with some embodiments, an assembly and method for supporting incremental propellant cells is discussed that separates and protects the propellant cells in a gun fired environment and ensures consistent and reliable gun firing of a projectile. Other features and advantages will become apparent from the following description of the preferred example, which description should be taken in conjunction with the accompanying drawings.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

FIGS. 6A-H are cross sectional and end views of another example of a propellant support assembly.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow surfaces, reinforcing structures, explosives and the like, which may carry out a variety of functions. In addition, the present subject matter may be practiced in conjunction with any number of devices, and the systems described are merely exemplary applications.

Figure 1:
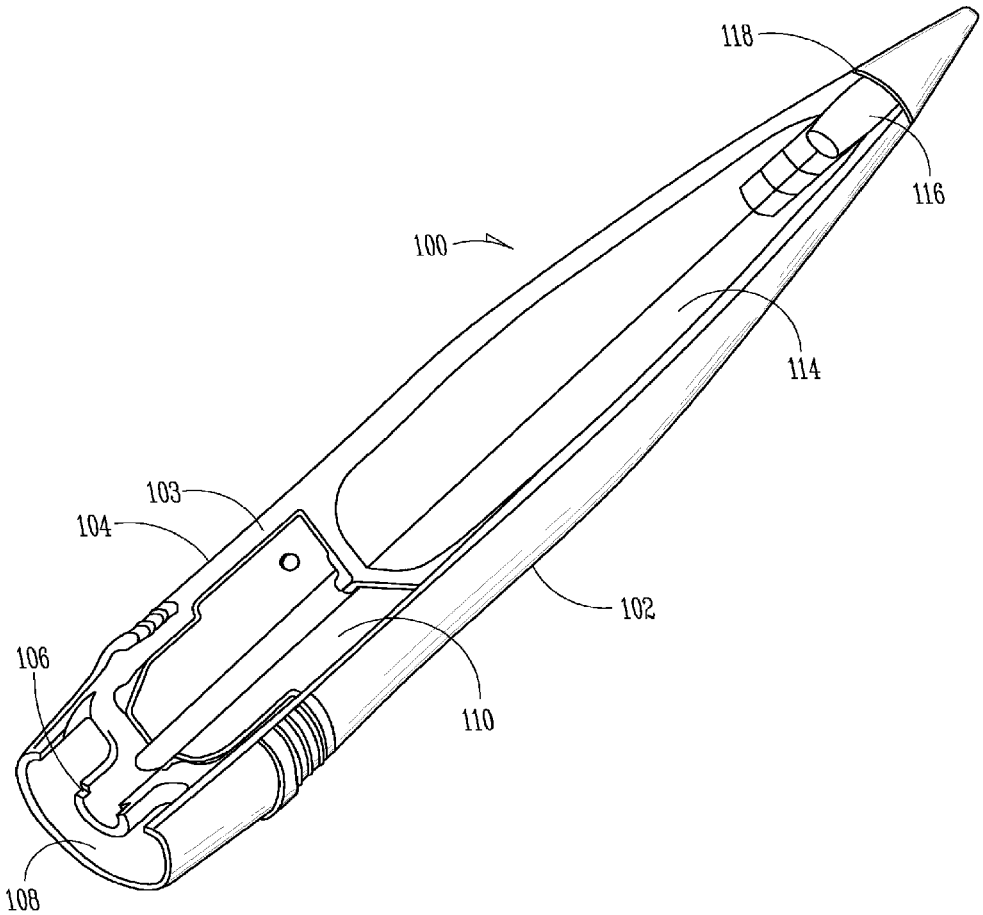
FIG. 1 (PRIOR ART)
FIG. 1 is a cross sectional perspective view a prior art rocket assisted, high explosive projectile.

FIG. 1 shows one example of a 155 mm M549 rocket assisted projectile 100 for use with a gun (i.e., a gun fired projectile). The gun fired projectile 100 includes a projectile body 102 including a rocket motor 103. In use, the gun fired projectile 100 is loaded into a gun, such as a 105 or 155 mm howitzer, and fired from the gun a propelling charge. After firing of the gun fired projectile 100 the rocket motor 103 including propellant 110 is ignited through an igniter 108 positioned within an exhaust nozzle 106 of the gun fired projectile 100. The propellant 110 provides one or more of acceleration or maintenance of a velocity from the gun thereby extending the range of the gun fired projectile 100 beyond the range of a projectile without the rocket motor 103. The gun fired projectile 100 further includes an explosive payload 114 and a fuze assembly 116 configured to detonate the explosive payload 114.

Referring again to the rocket motor 103, the motor includes a rocket motor housing 104 containing the propellant cell 110. As shown in FIG. 1, the propellant cell 110 is disposed adjacent to the exhaust nozzle 106. In the example shown in FIG. 1, the exhaust nozzle 106 includes an igniter 108 configured to ignite the propellant cell 110 upon firing from a gun.

As will be described in further detail below, support assemblies are described herein to support a plurality of propellant cells and thereby distribute inertial forces incident on each of the cells during firing to a rocket motor housing. Transmission of inertial forces from the individual propellant cells to the rocket motor housing without interposing transmission to the adjacent propellant cells minimizes compressive loading on the cells. For instance, inertial forces incident on a first propellant cell are transmitted through the support assembly to the rocket motor housing. The second propellant cell near the housing distal end (e.g., near an exhaust nozzle) is isolated from the inertial forces of the first propellant cell and thereby is not compressed by those inertial forces. Stated another way, the support assemblies suspend at least the first propellant cell relative to the second propellant cell and prevent stacking of the first propellant cell on the second propellant cell.

Figure 2:
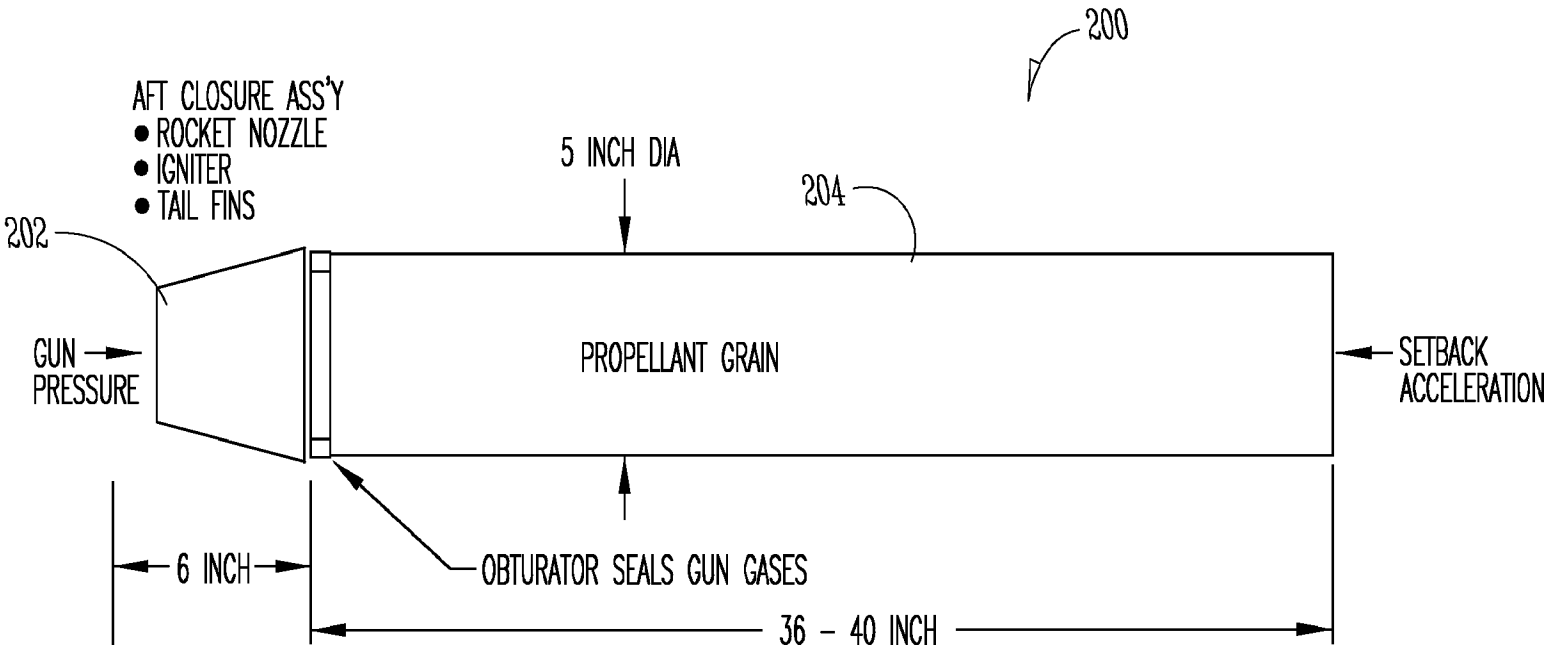
FIG. 2 (PRIOR ART)
FIG. 2 is a schematic view of one example of a gun fired rocket motor.

FIG. 2 shows a schematic diagram of a prior art rocket motor 200. The rocket motor 200 includes an exhaust nozzle 202 and a propellant grain 204. In contrast to the gun fired projectile 100 shown in FIG. 1, the rocket motor 200 includes a single unitary propellant grain 204 in contrast to multiple propellant cells separated by a support assembly, such as the support assembly 120 shown in FIG. 1. When the rocket motor 200 shown in FIG. 2 is fired from a gun the rocket motor 200 is propulsively delivered from the gun according to pressure incident on the exhaust nozzle 202. The propellant grain 204 is subject to a setback acceleration that creates an inertial force (e.g., a force caused by the setback acceleration) in an opposing direction to the gun pressure.

Because the rocket motor 200 includes a unitary large propellant grain 204 the acceleration forces incident on the propellant grain 204 develop a column force load that is transmitted to the end of the propellant grain adjacent to the exhaust nozzle 202. The column load compresses the propellant grain. In some examples, the column load from the setback acceleration forces fractures the propellant grain 204. The fracture of the propellant grain 204 causes the propellant grain, in at least some examples, to burn unpredictably and affects the range and accuracy of the projectile containing the rocket motor 200. Further, in some examples, fractures within the propellant grain 204 caused for instance by the column force load on the unitary grain cause an in bore initiation of the rocket motor within the gun due to adiabatic compression of the propellant grain. Stated another way, ignition of the propellant grain 204 takes place at the fracture caused by the compression forces unpredictably and catastrophically ignites the propellant grain 204.

In still other examples, the propellant grain 204 is difficult to inspect relative to the multiple propellant grains 110, 112 shown in FIG. 1. Fractures and the like formed within the volume of the propellant grain 204 are difficult to detect because of the size of the unitary grain. Where the propellant grain 204 includes fractures or other defects from the manufacturing process the propellant grain 204 is subject to unpredictable burning as well as in bore initiation due to adiabatic compression when fired from a gun.

In another example, where the rocket motor 200 is exposed to a high temperature environment (e.g., the interior of a gun barrel after sustained firing) the propellant grain 204 expands within the rocket motor 200 and minimizes any space needed for a predictable ignition of the rocket motor. Subsequent ignition of the rocket motor 200 within the minimized space creates unexpected high pressures within the projectile containing the rocket motor 200. These high pressures unpredictably increase the burn rate of the propellant 204 thereby further increasing the pressure (and then further increasing the burn rate). Unpredictable burning of the propellant may negatively affect the flight characteristics of the gun fired projectile containing the rocket motor 200 (e.g., range and accuracy).

Figure 3E:
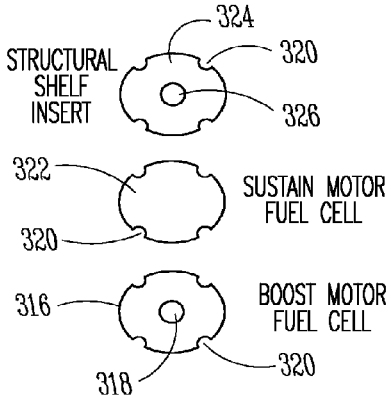
FIGS. 3A-E are cross sectional and end views of one example of a propellant support assembly.
Figure 3B:
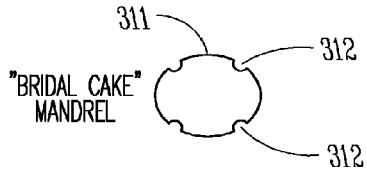
Figure 3A:
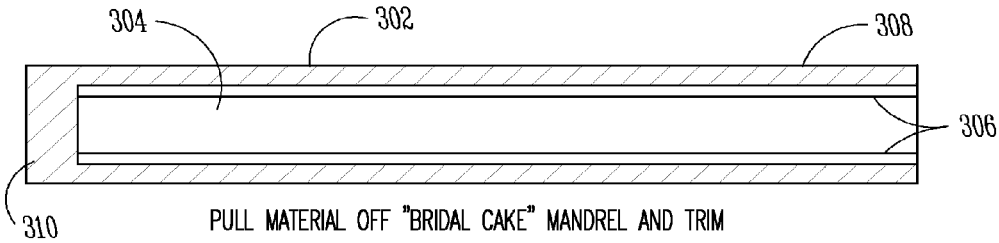

FIGS. 3A through 3E show one example of a rocket motor 300 in various states of assembly. Referring first to FIG. 3A, the rocket motor housing 302 is shown and includes a pressure chamber 304 (e.g., housing barrel) extending between a housing proximal end 308 and housing distal end 310. As shown in FIG. 3A, the rocket motor housing 302 further includes keyed ribs 306 extending through the pressure chamber 304.

Referring to FIG. 3B, one example of a keyed mandrel 311 is shown. The keyed mandrel includes key shapes 312 formed in the keyed mandrel 311 and the key shapes 312 form the keyed ribs 306. For example, flow forming of the material forming the rocket motor housing 302 over the keyed mandrel 311 correspondingly forms the keyed ribs 306 within the rocket motor housing. As will be described in further detail below, the keyed ribs 302 formed by the key shapes 312 engage with corresponding keyed recesses in the multiple propellant cells used in the rocket motor 300 to substantially prevent rotation of the propellant cells within the rocket motor housing 302 during the firing of the gun. Gun barrels are typically rifled and firing of the rocket motor housing 302 with the propellant cells therein delivers rotational forces to the rocket motor housing 302. By engaging the keyed ribs 306 with the corresponding keyed recesses 320 of the propellant cells rotation between the cells and rocket motor housing 302 is substantially prevented.

Figure 3C:
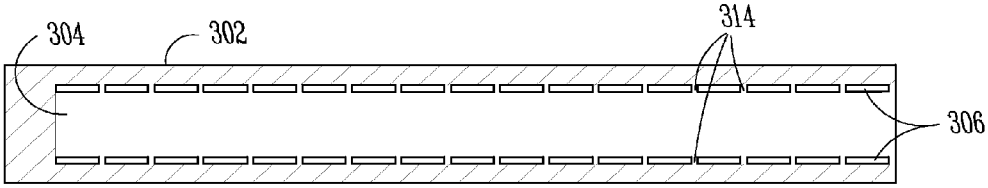

FIG. 3C shows the rocket motor housing 302 in a second stage of construction. The keyed ribs 306 are machined to form support shelves 314 along the pressure chamber 304. As will be described in further detail below, the support shelves 314 facilitate the rotation of supports, such as support plates 324, within the recesses to axially lock the support plates 324 in position within the rocket motor housing 302.

Figure 3D:
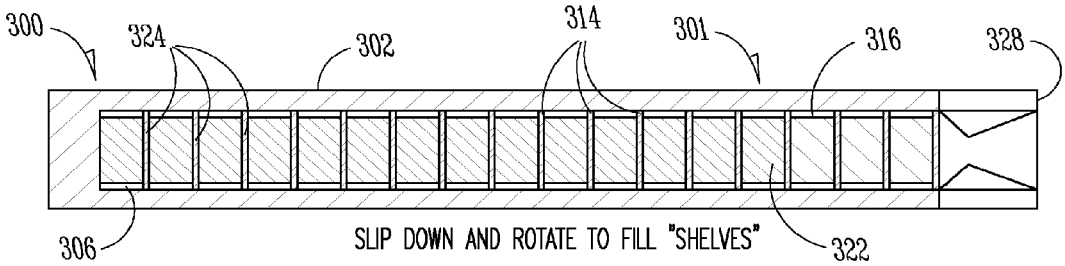

Referring now to FIGS. 3D and 3E, the complete rocket motor 300 is shown in FIG. 3D and the propellant cells 316, 322 and the support plate 324 are shown in FIG. 3E. The rocket motor 300 includes a plurality of propellant cells including, for instance, boosting propellant cells 316 and sustaining propellant cells 322. The boosting propellant cells accelerate the rocket motor 300 and the sustaining propellant cells maintain the velocity of the rocket motor. Each of the propellant cells 316, 322 is positioned within the rocket motor housing 302 and separated from adjacent propellant cells by the support plates 324 interposed therebetween. As shown in FIG. 3D, the support plates 324 (e.g., supports) are received within the support shelves 314 formed in the keyed ribs 306. The support shelves 314 are interposed between each of the propellant cells and substantially isolate adjacent propellant cells from each other and prevent the transmission of forces between the cells when the projectile is fired from a gun. The support plates 324 in combination with the support shelves 314 and the keyed ribs 306 form a support assembly to separately suspend each of the propellant cells.

Referring now to FIG. 3E, examples of the booster propellant cell 316, the sustaining propellant cell 320 and the support plate 324 are shown in with end views. Each of the cells 316, 322 and the support plates 324 include keyed recesses 320 sized and shaped to receive the keyed ribs 306 shown in FIGS. 3A, 3C and 3D. During assembly the propellant cells 316, 322 and support plate 324 are positioned within the pressure chamber 304 with the keyed ribs 306 received within the keyed recesses 320. In one example, a first sustaining propellant cell 322 is positioned within the pressure chamber 304 and moved through the pressure chamber toward the housing distal end 310. The keyed ribs 306 and keyed recesses 320 align to facilitate delivery of the propellant cell 322 down the pressure chamber to the distal position shown in FIG. 3D. Thereafter, a first support plate 324 is slid down the pressure chamber 304 into a position adjacent to the propellant cell 322. Additional propellant cells 322 are thereafter delivered down the pressure chamber 304 with support plates 324 interposed therebetween.

In the example shown in FIG. 3D, after positioning of a support plate 324 adjacent to the preceding propellant cell 316, 322 the support plate 324 is rotated relative to the rocket motor housing 302. Rotation of the support plate 324 is permitted because of the support shelves 314 cut into to the keyed ribs 306. By rotating the support plates 324 relative to the keyed ribs 306 the keyed recesses 320 are moved out of alignment with the keyed ribs 306 thereby substantially preventing axial movement of the support plates 324 (e.g., supports) relative to the rocket motor housing 302. By engaging the support plates 324 with the keyed ribs 306 of the rocket motor housing 302 axial forces, such as inertial forces, incident on the propellant cells 322, 316 are transmitted to the support plates 324 and then into the rocket motor housing 302 without transmission into adjacent propellant cells. Stated another way, the support plates 324 in combination with the keyed ribs 306 and the rocket motor housing 302 substantially isolate each of the propellant cells 320, 316 from adjacent propellant cells. Each propellant cell 316, 320 is thereby only subjected to compression forces caused by its own weight and not the weight of any preceding propellant cells 316, 320. Propellant cells near the housing proximal end 308 thereby experience the same compression loading as propellant cells near the housing distal end 310 because inertial forces incident on each of the propellant cells 316, 320 when accelerated ("a" in FIG. 3D) are delivered to the rocket motor housing 302 and not to the proximal propellant cells.

Furthermore, because the propellant cells 316, 320 include keyed recesses 320 the propellant cells are substantially prevented from rotating from within the rocket motor housing 302 when fired from a rifled gun barrel. The keyed ribs 306 received within the keyed recesses 320 substantially prevent rotation and corresponding frictional engagement of the propellant cells 316, 320 with the rocket motor housing 302. Moreover, the key features, such as the keyed ribs 306 and the keyed recesses 320 on the support plates 324, substantially prevent axial compression loading through stacking of propellant cells 316, 320 when the keyed recesses 320 are moved out of alignment with the keyed ribs 306. The support plates 324 and the keyed ribs 306 thereby provide a support assembly 301 configured to support the propellant cells 316, 320 during gun firing of a projection containing the rocket motor 300.

The support plate 324 shown in FIGS. 3D and 3E is constructed with materials capable of withstanding inertial loads transmitted by a single propellant cell such as the propellant cells 316, 320. The support plates 324 are constructed with, but not limited to, aluminum, titanium, steel and the like. The support plates 324 are constructed with materials capable of maintaining the adjacent propellant cells 316, 320 in a substantially static position to prevent compressive stacking of the propellant cells. Furthermore, the cooperating parts of the rocket motor housing 302, such as the keyed ribs 306, are constructed with similarly robust materials configured to receive the transmitted inertial forces of the propellant cells 316, 320 from the support plates 324.

In the examples shown in FIG. 3D, two types of propellant cells 316, 320 are positioned within the rocket motor housing 302. As shown the distal most propellant cells include sustaining propellant cells 322. In contrast, the proximal propellant cells 316 include boosting propellant cells having different propellant chemistry from the sustaining propellant cells 320. As described above, the boosting propellant cells 316 are configured to provide acceleration to the projectile carrying the rocket motor 300. In the example shown in FIG. 3E, the boosting propellant cell 316 includes a hollow core 318 sized and shaped to accelerate the burning of the boosting propellant cell 316 and thereby create increased thrust to a projectile carrying the rocket motor 300. In contrast, the sustaining propellant cell 322 includes a different chemistry configured to sustain a velocity of the rocket motor 300 during flight.

Because the rocket motor 300 includes multiple propellant cells the motor is selectively assembled with specified propellant cells according to the payload delivered by the projectile, the range needed for delivery and the like. Stated another way, each projectile using the rocket motor 300 is configurable to include a plurality of propellant cells sized and shaped to provide one or more specified desired flight characteristics in contrast to a single propellant grain with a single function. After the propellant cells 316, 322 and support plates 324 are positioned within the pressure chamber 304 an exhaust nozzle 328 is coupled with the rocket motor housing 302 to finish the rocket motor 300.

Figure 4A:
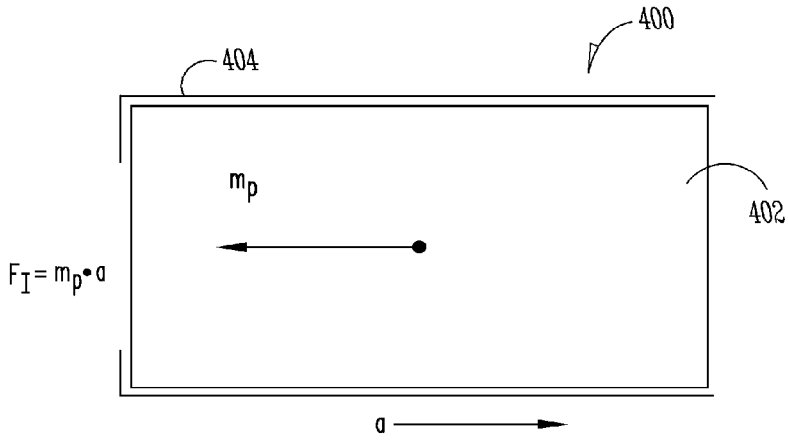
(PRIOR ART) FIG. 4A
FIG. 4A is a free body diagram showing inertial forces incident on a prior art unitary propellant cell.
Figure 4B:
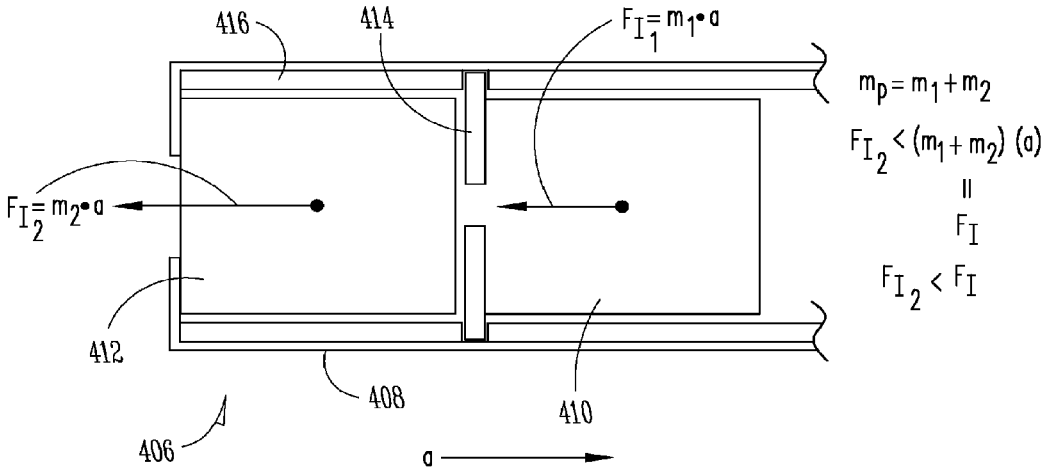
FIG. 4B is a free body diagram showing inertial forces incident on individual propellant cells suspended within a rocket motor housing.

FIGS. 4A and 4B show two examples of rocket motors 400, 406. Referring first to the rocket motor 400 shown in FIG. 4A, the rocket motor includes a rocket motor housing 404 including a unitary propellant cell 402 having a propellant cell mass ($m_p$). When fired from a gun the first rocket motor 400 within a projectile is accelerated to around 12,000 g. Accelerating the first rocket motor 400 creates an opposite setback acceleration for the unitary propellant cell 402. The setback acceleration applies an inertial force $F_i$ on the unitary propellant cell. As shown in FIG. 4A, the inertial force $F_i$ is equal to the mass of propellant cell multiplied by the acceleration (e.g., 12,000 g). As previously described, the use of large unitary propellant cells generates corresponding large inertial forces that compress the unitary propellant cell 402. The compression increases toward the propellant cell base 401 through a stacking effect (the preceding mass compresses the cell base) causing adiabatic compression. Where a fracture is present within the unitary propellant cell 402, for instance, from compression loading or during manufacture the adiabatic compression may cause unintended initiation of the unitary propellant cell and failure of the first rocket motor 400 either in the gun barrel or after firing.

Referring now to FIG. 4B, the second rocket motor 406 includes a rocket motor housing 408 including first and second propellant cells 410, 412. As shown, a support plate 414 is positioned within the rocket motor housing 408 along keyed ribs 416. As previously discussed with regard to the rocket motor 300, the support 414, in one example, is rotated relative to the keyed ribs 416 to move key recesses on the support out of alignment with the keyed ribs 416. Rotation of the support 414 out of alignment axially fixes the support 414 within the rocket motor housing 408 and allows for transmission of inertial forces incident on each of the propellant cells 410, 412 to the rocket motor housing 408.

As shown in FIG. 4B, each of the propellant cells 410, 412 has a respective mass $m_1$, $m_2$. The masses of the first and second propellant cells when combined is equivalent to the mass of the unitary propellant cell 402 shown in FIG. 4A. Upon firing of a projectile including the second rocket motor 406 from a gun the first and second propellant cells 412, 410 are accelerated, for instance, to 12,000 g. The propellant cells 401, 412 experience a setback acceleration corresponding to the acceleration from the gun. The setback acceleration applies separate inertial forces within the respective propellant cells 410, 412. As shown in FIG. 4B, the inertial forces are shown as $F_{11}$ and $F_{12}$. The inertial force incident on the first propellant cell 410 (e.g., $F_{11}$) is equivalent to the mass of the first propellant cell, $m_1$, multiplied by the acceleration. The inertial force incident on the first propellant cell 410 is transmitted through the support plate 414 into the rocket motor housing 408 through engagement of the support 414 with the keyed rib 416. The inertial force ($F_{11}$) is not transmitted to the second propellant cell 412. Instead, the second propellant cell 412 receives an inertial force (e.g., $F_{12}$) equal to the mass of the second propellant cell $m_2$ multiplied by the acceleration, approximately 12,000 g. The inertial force of the second propellant cell $F_{12}$ is transmitted separately to the rocket motor housing 408.

The inertial force incident on the second propellant cell 412, $F_{12}$, is less than the inertial force experienced by the unitary propellant cell 402 shown in FIG. 4A. As shown in the inequality in FIG. 4B, the force $F_{12}$ is less than the quantity of $m_1$ plus $m_2$ times the acceleration incident on the rocket motor (400, 406). The quantity $m_1$ plus $m_2$ multiplied by the acceleration is equal to the inertial force applied to the unitary propellant cell 402 because the masses of the first and second propellant cells 410, 412 are equivalent to the mass of the unitary propellant cell 402. $F_{12}$ is thereby less than $F_1$, the inertial force on the unitary propellant cell 402. As shown in this relationship, the inertial force experienced by the second propellant cell 412 is substantially less than the inertial force experienced by the unitary propellant cell 402. The second propellant cell 412 is thereby exposed to less corresponding compression relative to the unitary propellant cell and subject to reduced adiabatic compression with the corresponding risk of premature initiation. Further, because the second propellant cell 412 is subject to less compressive loading the risk of fracturing the second propellant cell 412 is substantially minimized. The support assembly (e.g., a support structure) including the support 414 and the keyed ribs 416 in combination with the rocket motor housing 408 thereby protects the second propellant cell 412 from compressive forces otherwise delivered by the first propellant cell 410 (as well as any preceding propellant cells positioned distally within the rocket motor housing 408 relative to the first and second propellant cells 410, 412).

Furthermore, because the second propellant cell 412 is substantially isolated from the compressive forces of distal propellant cells, including for instance the first propellant cell 410, the second propellant cell is more tolerant to manufacturing errors including fractures within the cell. Stated another way, adiabatic compression of the second propellant cell 412 with a fracture therein is subject to a minimized risk of premature initiation and rapid burning relative to a larger propellant cell mass experiencing the same acceleration and greater compression.

Figure 5:
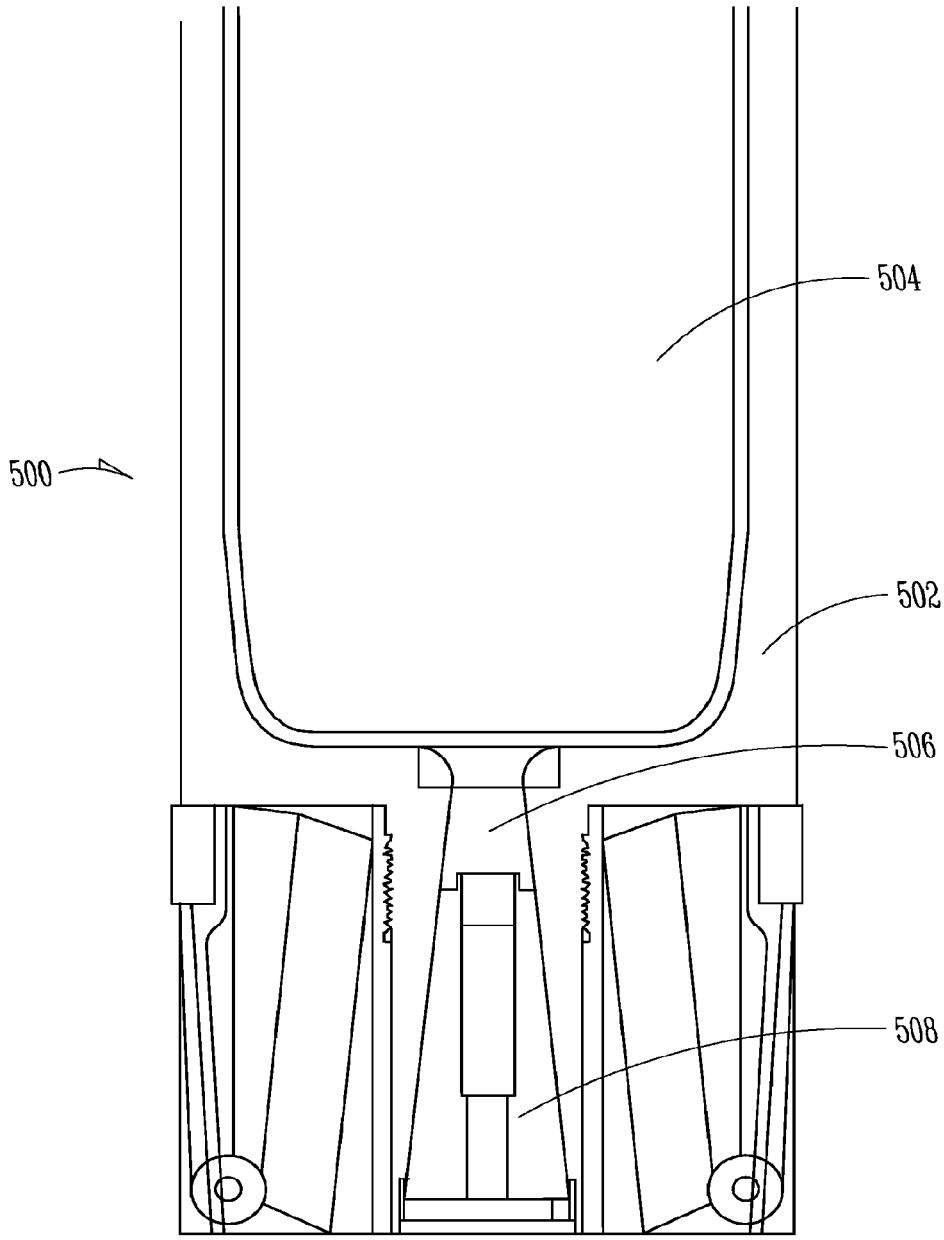
FIG. 5 is a detailed cross sectional view of one example of a rocket motor housing and exhaust nozzle including a void between an ignition cartridge and a propellant cell.

FIG. 5 shows another example of a rocket motor 500, including a rocket motor housing 502 and a propellant 504 such as an incremental propellant including multiple propellant cells housed in a support structure as previously described herein. The rocket motor housing 502 includes an ignition cartridge 508 positioned proximally relative to the propellant 504 with a void 506 disposed therebetween. One example of the void 506 is filled with an inert material sized and shaped to provide structural support to the propellant 504 immediately lying above the ignition cartridge 508.

As previously described, the support structure (e.g., support assembly) including, for instance, the support plates 324 and keyed ribs 306 shown in FIG. 3D suspend the propellant cells 316, 320 within the rocket motor housing. With a similar assembly within the rocket motor housing 502 the propellant 504 includes a plurality of propellant cells suspended by supports, such as the support plates 324. The support assembly including the support plate isolates the individual propellant cells from compressive loading from adjacent propellant cells due to acceleration forces incident on each of the cells. Because the propellant cell adjacent to the void 506 and the ignition cartridge 508 is subjected to substantially less compression forces than, for instance, a unitary propellant cell, the propellant cell is less likely to expand into the void 506 when compressed by firing from a gun. By maintaining the void 506 between the ignition cartridge 508 and the propellant 504 the ignition cartridge is able to consistently and reliably ignite and then smoothly combust the propellant 504. Stated another way, the support assembly ensures that the space provided by the void is maintained during gun firing thereby avoiding a reduction of space in the void 506 with corresponding increased pressures and faster ignition that may negatively affect the ignition and burning of the propellant 504. The support assembly, such as the support plates 324 and keyed ribs 306 shown in FIGS. 3A-D cooperates with the ignition cartridge 508 to ensure a smooth ignition of the propellant 504 despite compressive loading of the propellant cells due to gun firing acceleration.

Figure 6A:
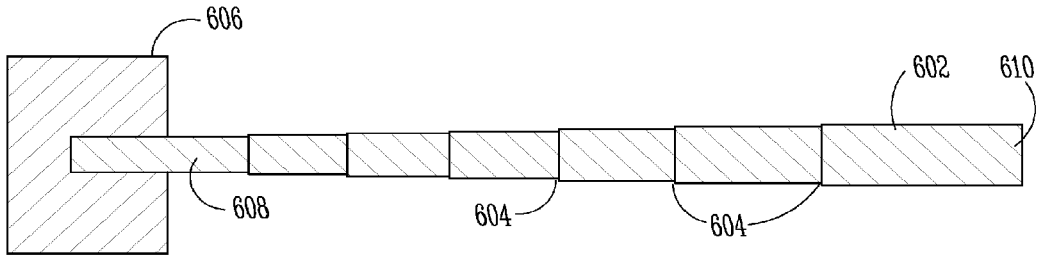
Figure 6B:
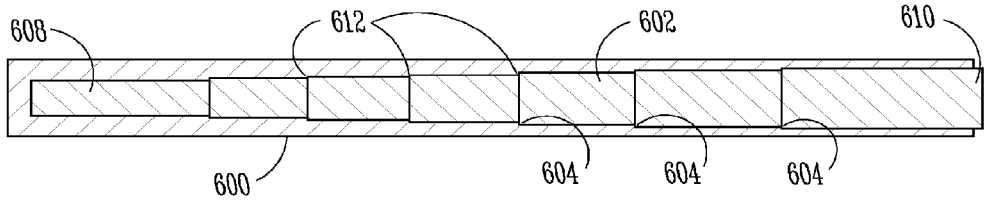

FIGS. 6A-H show another example of a rocket motor housing 600 for use in a gun fired projectile. Referring first to FIG. 6A, one example of graduated mandrel 602 is shown. The graduated mandrel 602 includes a series of progressive mandrel steps 604 sized and shaped to create corresponding shelves within the rocket motor housing, described below. The graduated mandrel 602 extends from a mandrel proximal end 608 to a mandrel distal end 610 and tapers from the mandrel distal end toward the mandrel proximal end. As shown in FIG. 6A, a housing material 606 is engaged with the mandrel proximal end 608. In one example, the housing material 606 is flow formed over the graduated mandrel 602 as shown in FIG. 6B. The housing material 606 includes, but is not limited to, metals such as aluminum, titanium, steel and the like.

Referring now to FIG. 6B, the rocket motor housing 600 is shown formed around the graduated mandrel 602. As previously described, the graduated mandrel includes mandrel steps 604. As the housing material 606 is flow formed over the graduated mandrel 602 the mandrel steps 604 form corresponding housing shelves 612 within the rocket motor housing 600. Where the mandrel steps 604 are annular steps extending around the graduated mandrel 602 the corresponding housing shelves 612 are also annular and extend around the circumference of the rocket motor housing interior. As shown, the rocket motor housing 600 has a progressively graduated inner shape with the housing shelves 612 consecutively positioned along the rocket motor housing 600 to form a pressure chamber 614 having a gradually increasing diameter.

Figure 6C:
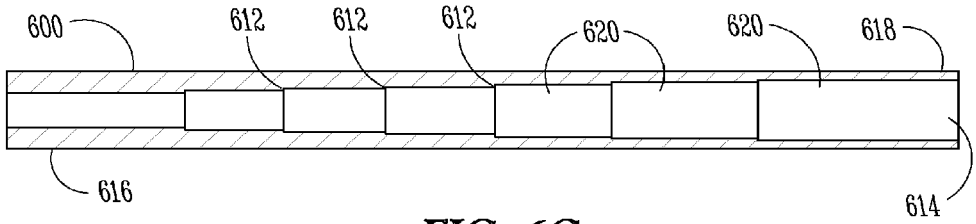

FIG. 6C shows the rocket motor housing 600 with the housing mandrel 602 removed thereby opening the pressure chamber 614 (e.g., housing barrel) with the housing shelves 612 therein. The rocket motor housing 600 includes a series of consecutive propellant sockets 620 that gradually increase in size from the housing proximal end 616 to the housing distal end 618. The propellant sockets 620 are separated from one another by the housing shelves 612 interposed therebetween. The housing proximal end 616 is trimmed to remove any remaining housing materials 606 from the flow forming process. As will be described in further detail below, the propellant socket 620 and the housing shelves 612 cooperate with a plurality of propellant cells having corresponding shapes and sizes and supports to retain the multiple propellant cells therein and support the propellant cells separately from each other.

Figure 6D:
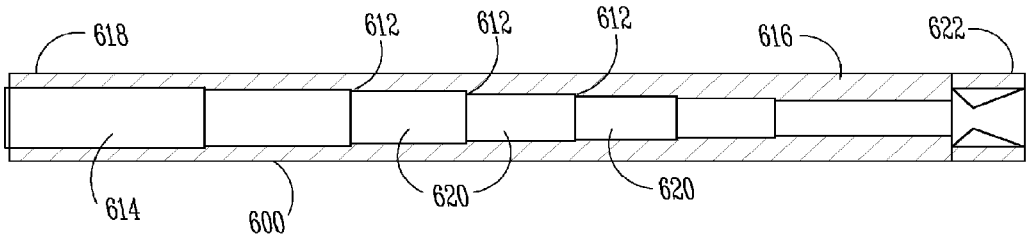

Referring to FIG. 6D, after the graduated mandrel 602 is removed from the rocket motor housing an exhaust nozzle 622 is coupled with the rocket motor housing 600. The rocket motor housing 600 including the pressure chamber 614 is left open at the housing distal end 618 to facilitate the installation of the supports and propellant cells. Optionally, the graduated pressure chamber 614 is formed in the rocket motor housing 600 with an oppositely tapering configuration, and the exhaust nozzle 622 is not installed until the propellant cells and the supports are installed. In still another example, after assembly of the rocket motor 601 including positioning of each of the propellant cells 624A-F, boosting propellant cell 622 and the interposing supports 624A-F a housing cap 630 is installed over the end of the pressure chamber 614 at the pressure chamber distal end 618.

Figure 6E:
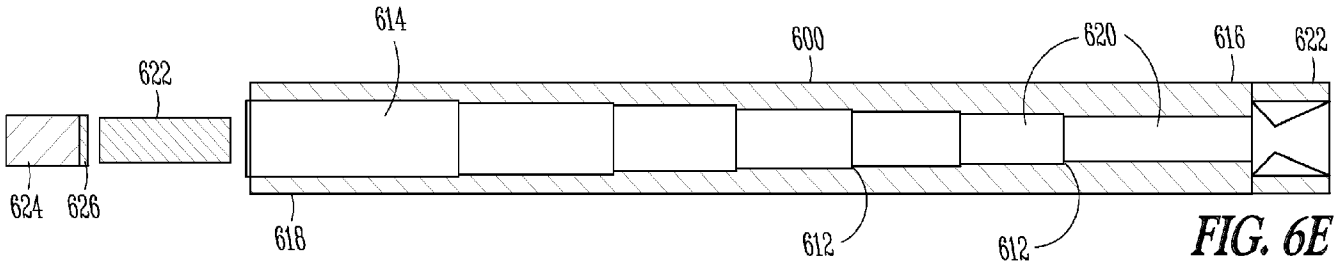

Referring now to FIG. 6E, the rocket motor housing 600 is shown with multiple propellant cells spaced from the housing in preparation for installation within the pressure chamber 614. In the example shown, the propellant cells include a boosting propellant cell 622 and a sustaining propellant cell 624. A support 626, such as a support plate, is interposed between the sustaining propellant cell 624 and the boosting propellant cell 622. As will be described in further detail immediately below, the support 626 engages with the correspondingly sized and shaped housing shelf 612 to suspend the sustaining propellant cell 624 relative to the boosting propellant cell 622 and thereby isolate the boosting propellant cell 622 from forces incident on the sustaining propellant cells 624.

Figure 6G:
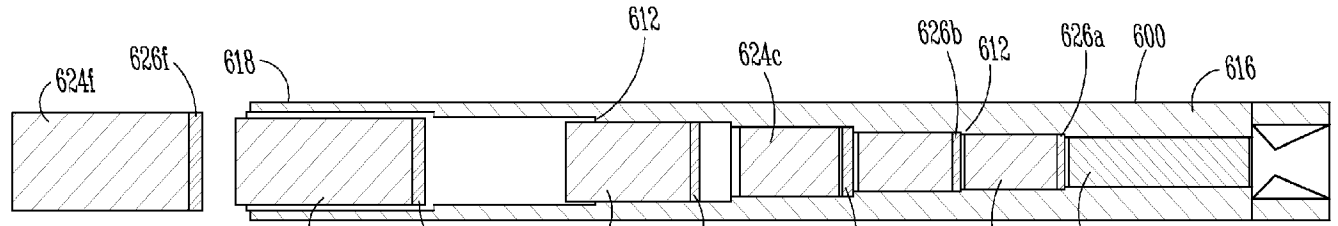

Referring now to FIG. 6G, the rocket motor housing 600 is shown with a plurality of sustaining propellant cells 624A-F sequentially positioned within the pressure chamber 614. Similarly, appropriately sized and shaped supports 626A-F are interposed between each of the propellant cells. As shown, each of the propellant sockets 620 formed in the pressure chamber 614 is sized and shaped to receive a correspondingly sized support 626 and sustaining propellant cell 624 (or boosting propellant cell 622). The first sustaining propellant cell 624A is shown near the housing proximal end 616 fully received within the corresponding propellant socket 620. The preceding support 626A is interposed between the boosting propellant cell 622 and the sustaining propellant cell 624A. As described in the previous example, the support 626A is sized and shaped to engage with a portion of the rocket motor housing 600. In the example, shown as FIG. 6G the support 626A engages with the correspondingly sized housing shelf 612. Engagement of the support 626A with the housing shelf 612 carries the sustaining propellant cells 624A during firing of a gun. As shown, the remaining sustaining propellant cells 624B-F are correspondingly sized for progressively larger propellant sockets 620. The sustaining propellant cells 624B-F and the corresponding supports 626B-F are sequentially positioned within the pressure chamber 614 with the supports 626B-F engaged with the corresponding housing shelves 612. Engagement of the supports 626A-F with the corresponding housing shelves 612 suspends each of the propellant cells 624A-F relative to adjacent propellant cells. The supports ensure inertial forces caused by setback acceleration incident on the propellant cells are transmitted through the rocket motor housing 600 directly without transmission of the acceleration forces to propellant cells positioned proximally relative to preceding propellant cells.

As shown in FIG. 6F, the propellant cells 624A-F, boosting propellant cell 622 as well as the supports 626A-F include keyed recesses 628. Referring back to FIGS. 6A and 6B, the graduated mandrel 602 includes corresponding key shapes formed along the mandrel. As the rocket motor housing 600 is formed over the graduated mandrel 602 the key shapes form corresponding keyed ribs in the rocket motor housing 600. Where the supports 626A-F, propellant cells 624A-F and 622 include corresponding keyed recesses the propellant cells are rotatably locked within the rocket motor housing 600 through engagement with the keyed ribs when installed to substantially prevent relative rotation between the propellant cells and the rocket motor housing 600. This eliminates rotational friction between the cells and the rocket motor housing.

In another example, in a similar manner to the rocket motor 300, the supports 626A-F include keyed recesses 628 and the keyed ribs within the rocket motor housing 600 include shelves formed through machining and the like to facilitate rotation of the supports 626A-F relative to the rocket motor housing 600. As previously described, rotation of the supports 626A-F moves the keyed recesses 628 out of alignment with the corresponding keyed ribs and axially fixes the supports 626A-F within the rocket motor housing 600.

Figure 6H:
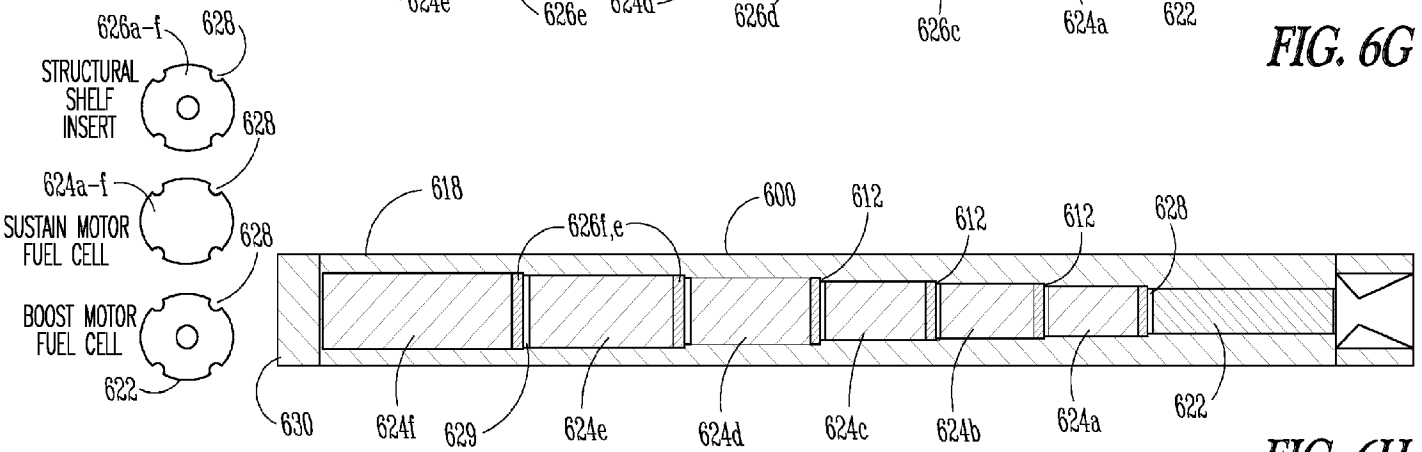

Through the engagement between the supports 626A-F, the corresponding housing shelves 612 of the rocket motor housing 600 (and in some examples the reception within the keyed recesses 628 of corresponding keyed ribs) the propellant cells 624A-F, 622 are suspended within the rocket motor housing 600 and substantially isolated with respect to adjacent propellant cells. As shown in FIG. 6H, the supports 626A-F are interposed between each of the sustaining propellant cells 624A-F and the boosting propellant cell 622. The supports 626A-F engage with the housing shelves 612 to suspend each of the propellant cells relative to the remainder of the propellant cells and substantially ensure transmission of forces incident on each of the propellant cells (e.g., forces caused by setback acceleration) to the rocket motor housing 600 without transmission to adjacent cells.

In another example, as shown in FIG. 6H the preceding propellant cells are spaced from the supports 626A-F by gaps 628. While not necessary to the construction of the rocket motor 601, the gaps 628 show the propellant cells 624A-F and the booster propellant cell 622 are separated by the supports 626A-F with engaged with the housing shelves 612 to substantially prevent the transmission of forces from one propellant cell to an adjacent propellant cell.

Figure 7A:
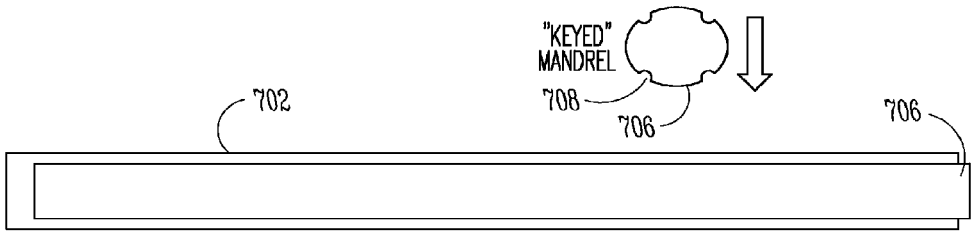
FIGS. 7A-G are cross sectional and end views of yet another example of a propellant support assembly.
Figure 7B:
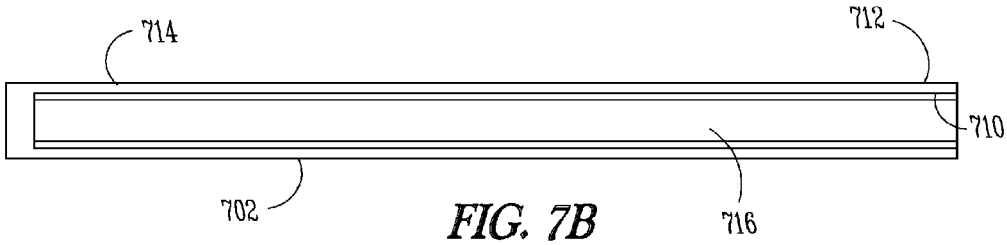

FIG. 7A-7E shown another example of a rocket motor 700, including a plurality of propellant cells and supporting structure to suspend the propellant cells relative to other adjacent propellant cells. Referring first to FIG. 7A, one example of a rocket motor housing 702 is shown formed over a mandrel 706. Referring to the end view of the mandrel 706, the mandrel includes key shapes 708 sized and shaped to create corresponding keyed ribs 710 in the rocket motor housing 702. The keyed ribs 710 are shown in FIG. 7B extending within a pressure chamber 716 (e.g., housing barrel) from a housing distal end 714 to a housing proximal end 712.

Figure 7C:
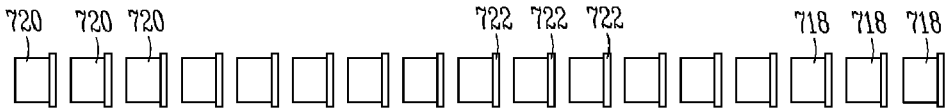
Figure 7D:
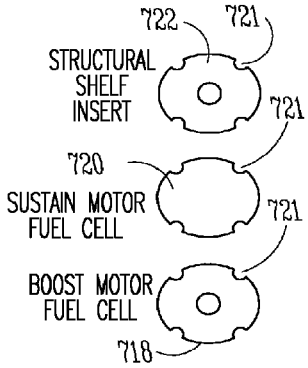

FIG. 7C shows a plurality of propellant cells such as sustaining propellant cells 720 and boosting propellant cells 718 in a linear arrangement. Each of the propellant cells 720, 718 is coupled with a support 722. In one example, the support 722 includes a support plate bonded to one surface of each of the propellant cells 720, 718. As shown in FIG. 7D, each of the supports 722, and propellant cells 720, 718, in one example, include keyed recesses 721 sized and shaped to engage with the corresponding features in the rocket motor housing 702 (e.g., the keyed ribs 710). As previously described above, the reception of keyed ribs 710 within the keyed recesses 721 substantially prevents rotation of the propellant cells 720, 718 and supports 722 relative to the rocket motor housing 702.

In the example shown in FIG. 7C, the technician is able to select any of a number of different propellant cells 720, 718 according to the needs of the projectile. As shown, the arrangement in FIG. 7C includes three boosting propellant cells 718 and 14 sustaining propellant cells 720. In other examples, more boosting propellant cells 718 are used relative to the sustaining propellant cells 720. In still other examples, tertiary types of propellant cells are included with the sustaining propellant cells 720 and booster propellant cells 718. For instance, intermediate boosting propellant cells with different propellant chemistry from the chemistries of the sustaining propellant cells 720 and the booster propellant cells 718 is included with the configuration shown in FIG. 7C to provide two different accelerations to the rocket motor 700.

Figure 7E:
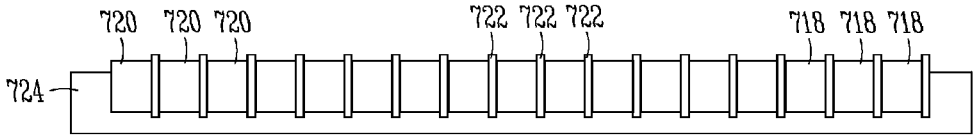

Referring now to FIG. 7E, the propellant cells 720, 718 with the supports 722 are positioned within an assembly fixture 724 prior to installation within a magazine. As shown, the assembly fixture 724 includes corresponding recesses sized and shaped to receive each of the propellant cells 718, 720 as well as the supports 722, such as the supporting plates shown in FIG. 7E. In one example, the assembly fixture 724 is further configured to compress the propellant cells 720, 718 into a configuration sized and shaped for reception within the magazine. Further, the assembly fixture 724 provides an easy to use assembly to position each of the propellant cells 720, 718 during assembly and inspection of the propellant for the rocket motor 700.

Figure 7F:
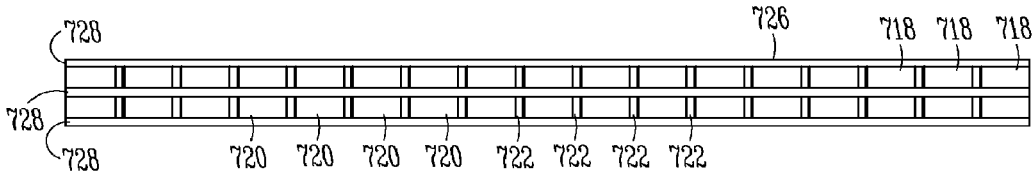

Referring now to FIG. 7F, the propellant cells 718, 720 and the supports 722 coupled with the propellant cells are positioned within a rail magazine 726. The rail magazine includes one or more rails 728 extending along the propellant cells 718, 720 as well as the supports 722. In one example, the rails 728 are affixed to the supports 722 through mechanical fittings including, but not limited to, bolts, screws, rivets, welds and the like. In another example, supports 722 are coupled with the rails 728 with chemical bonds such adhesives and the like. In still other examples, the rails 728 are coupled with the supports 722 through mechanical fittings, such as clamps, cotter pins, and the like. As shown in FIG. 7F, the rails 728 cooperate with the supports 722 to provide a support assembly or support structure configured to retain the propellant cells 718, 720 in the orientation shown in the assembly fixture 724. Installation of the propellant cells 718, 720 within the rail magazine 726 provides a single unitary magazine 726 for easy positioning within the rocket motor housing 702.

Additionally, the rail magazine 726 assists in suspending the propellant cells 718, 720 relative to other adjacent propellant cells during firing of the projectile containing the rocket motor 700 with a gun. For instance, the rails 728 of the rail magazine 726 provide an exoskeleton when coupled with the supports 722 that axially fixes each of the supports 722 relative to the rails 728. Inertial forces incident on each of the propellant cells 718, 720 when firing the gun fired projectile are transmitted from each of the propellant cells 718, 720 into the corresponding supports 722 and then transmitted along the rails 728 of the rail magazine 726. As in previous examples, the rail magazine 726 thereby isolates each of the propellant cells 718, 720 from the inertial forces of adjacent propellant cells and substantially prevents compression caused by preceding propellant cells.

Figure 7G:
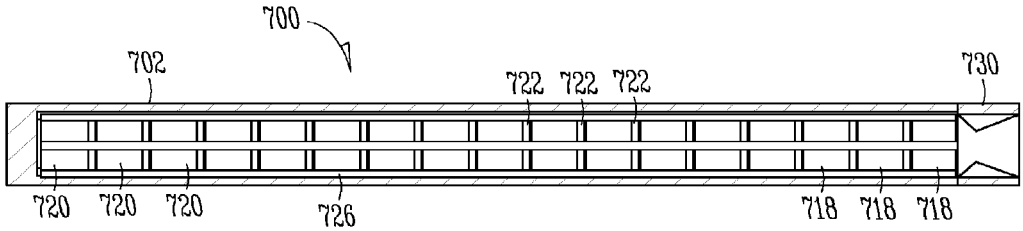

Referring now to FIG. 7G, the rail magazine 726 including the rails 728, supports 722 and propellant cells 718, 720 is installed within the rocket motor housing 702. In one example, the rail magazine 726 is slid into the rocket motor housing and the rails 728 are positioned within the rocket motor housing 702 out of alignment with the keyed ribs 710 shown in FIG. 7B. An exhaust nozzle 730 is thereafter coupled over the open end of the pressure chamber 716 to finish the rocket motor 700. By placing the rail 728 out of alignment with the keyed rib 710 rotation of the rocket motor 700, for instance, as the rocket motor in the gun fired projectile is fired from a gun causes the rail 728 to engage with the keyed rib 710 thereby preventing further rotation of the rail magazine 726 and the propellant cells 718, 720 therein relative to the rocket motor housing 702. Stated another way, the rails 728 engage with the 710 keyed ribs to substantially prevent rotation of the propellant cells 718, 720 and thereby prevent the associated frictional heating of the propellant cells. Further, as previously described above, the rails 728 of the rail magazine 726 cooperate with the supports 722 to substantially prevent axial movement of the propellant cells 718, 720 during acceleration of the rocket motor 700 when fired from a gun. The rail magazine 726 thereby isolates the propellant cells 718, 720 rotationally and axially to substantially prevent the axial transmission of inertial forces to propellant cells near the housing proximal end 712 while also preventing frictional heating of the propellant cells through rotation of the cells relative to the rocket motor housing 702. In still other examples, the rocket motor housing 702 does not include the keyed rib 710. Instead the rails 728 are bonded with the interior of the rocket motor housing, for instance, with welds, adhesives and the like. Optionally, the rails 728 are fixed within the rocket motor housing 702 with mechanical features such as pins, bolts, screws and the like.

Figure 8A:
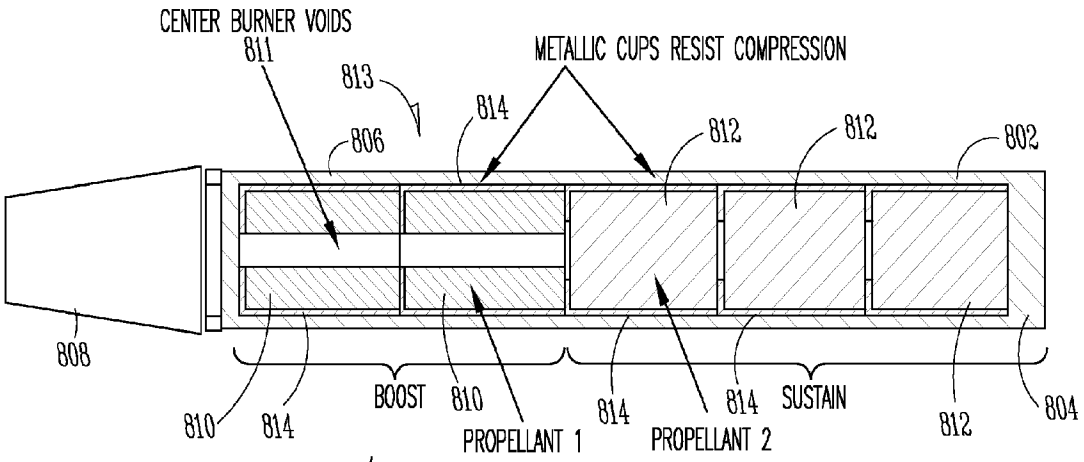
FIGS. 8A-B are cross sectional views of still another example of a propellant support assembly.

FIG. 8A shows another example of a rocket motor 800 including a support structure 813 (e.g., a support assembly). As previously described in another example, the rocket motor 800 includes a plurality of propellant cells 810, 812 including boosting propellant cells and sustaining propellant cells. The propellant cells are contained within a rocket motor housing 802 extending from a housing proximal end 806 to a housing distal 804. In one example, the boosting propellant cells 810 include center voids 811 extending therethrough. The center voids 811 facilitate rapid ignition and burning of the boosting propellant cells 810 to maximize the acceleration of the rocket motor 800. The rocket motor 800 further includes an exhaust nozzle 808 coupled with the rocket motor housing 802 at the housing proximal end 806.

Figure 8B:
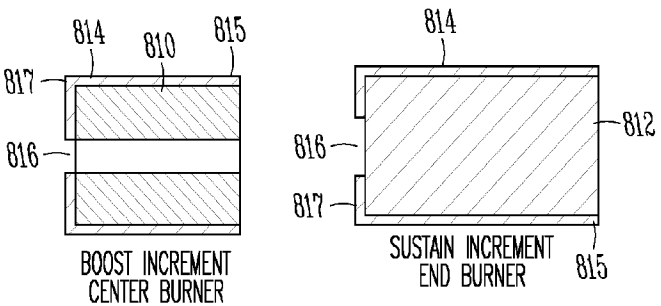

The support structure (e.g., a support assembly) 813 includes, in one example, a plurality of support cups 814 positioned within the rocket motor housing 802. As shown in FIG. 8A, each of the plurality of propellant cells 810, 812 includes an individual support cup 814. Referring now to FIG. 8B, the individual propellant cells 810, 812 are shown with corresponding support cups 814 engaged therearound. The support cups 814 include sidewalls 815 extending around the circumference of each of the propellant cells 810, 812 with a base 817 coupled with one end of the sidewall 815. A support passage 816 extends through each of bases 817 to permit a preceding burning propellant cell to ignite distally positioned propellant cells. In one example, the support cup 814 is constructed with a robust material including but not limited to steel, aluminum, titanium and the like. Similar to the previously described support structures, the support cups 814 are configured to receive inertial forces incident on each of the propellant cells generated by setback acceleration and transmit the inertial forces directly to the rocket motor housing 802 without transmitting compressive forces to proximally positioned propellant cells.

Referring to FIG. 8A, the support cups 814 of each of the propellant cells 810, 812 are arranged within the rocket motor housing 802 linearly. Each of the support cups 814 are engaged with one or more of proximal and distal support cups 814 for the adjacent propellant cells 810, 812. The support cups 814 including the sidewalls 815 and bases 817 are sized and shaped to engage with adjacent support cups thereby creating a robust structure sized and shaped to support the propellant cells 810, 812 and transmit compressive forces through the support cups 814 without transmitting forces into the corresponding propellant cells. For example, during firing of a gun using the rocket motor 800 within a gun fired projectile the propellant cells 810, 812 are subject to a setback acceleration. The setback acceleration generates forces in each of the propellant cells 810, 812 (e.g., inertial forces). These inertial forces are transmitted proximally through the rocket motor 800. Because the rocket motor 800 includes a support structure 813 the inertial forces incident on, for instance, the distal sustaining propellant cells 812 are transmitted from each of the individual propellant cells 812 into the corresponding support cups 814. The inertial forces are thereafter transmitted along the support cups 814 engaged with each other and transmitted to the rocket motor housing 802. Because each of the support cups 814 suspends the corresponding propellant cells 810, 812 contained therein the inertial forces transmitted through the support cups 814 are not transmitted into the corresponding propellant cells. Stated another way, each of the propellant cells 810, 812 are isolated from the inertial forces and corresponding compression created by transmission of inertial forces through a large unitary propellant cell. The support structure 813 instead absorbs the inertial forces and transmits those forces to the rocket motor housing 802.

Figure 9A:
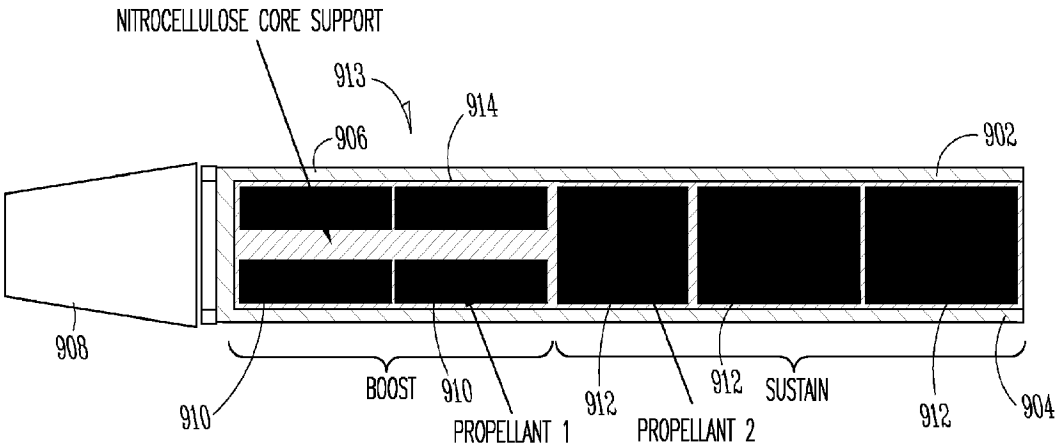
FIGS. 9A, B are cross sectional views of an additional example of a propellant support assembly.

FIG. 9A shows yet another example of a rocket motor 900 including a support structure 913 (e.g., a support assembly). As described in other previous examples, the rocket motor 900 includes a rocket motor housing 902 extending between a housing proximal end 906 and a housing distal end 904. An exhaust nozzle, 908 is coupled near the housing proximal end 906. A plurality of propellant cells 910, 912 such as boosting propellant cells 910 and sustaining propellant cells 912 are contained within the rocket motor housing 902. The support structure 913 includes, in this example, a nitrocellulose grain support 914 (e.g., a paper skeleton or frame work) supporting each of the propellant cells 919, 912 individually. The nitrocellulose grain support 914 thereby isolates each of the propellant cells from inertial forces transmitted from adjacent propellant cells.

Figure 9B:
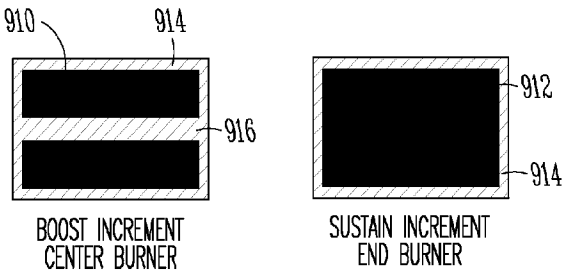

The support structure 913 shown in FIG. 9A, includes nitrocellulose grain support 914, or skeleton. As with other examples, the nitrocellulose grain support 914 provides structural support to the plurality of propellant cells 910, 912 and isolates each of the propellant cells from forces incident on adjacent or preceding propellant cells. Referring to FIG. 9B, individual nitrocellulose grain supports 914 are shown coupled around (e.g., encasing) each of the propellant cells 910. In one example, the boosting propellant cells 910 include nitrocellulose cores 916 extending through center voids of each of the boosting propellant cells 910. The nitrocellulose grain support 914 including the nitrocellulose grain support 916 is burned by the ignition and burning of the boosting and sustaining propellant cells 910, 912. Stated another way, after the projectile including the rocket motor 900 is fired from a gun the paper frame 914 has served its purpose (i.e., support of the individual propellant cells 910, 912) and is thereafter consumed by the ignition and burning of the propellant cells. In another example, the nitrocellulose grain support 914 (e.g., paper frame) is formed in a single step around a plurality of propellant cells 910, 912 in contrast to the individually encased propellant cells 910, 912 shown in FIG. 9B. In another example, the propellant cells 910, 912 are encased as a whole when arranged within a nitrocellulose encasing mechanism. The propellant cells 910, 912 are thereby formed into an assembly of propellant cells held within the support structure 913. In one example, the nitrocellulose grain support 914 is formed with but not limited to nitrocellulose. Because of the energetic nature of nitrocellulose, it provides the necessary structural support and additional energetic materials for the rocket motor propulsion.

Figure 10:
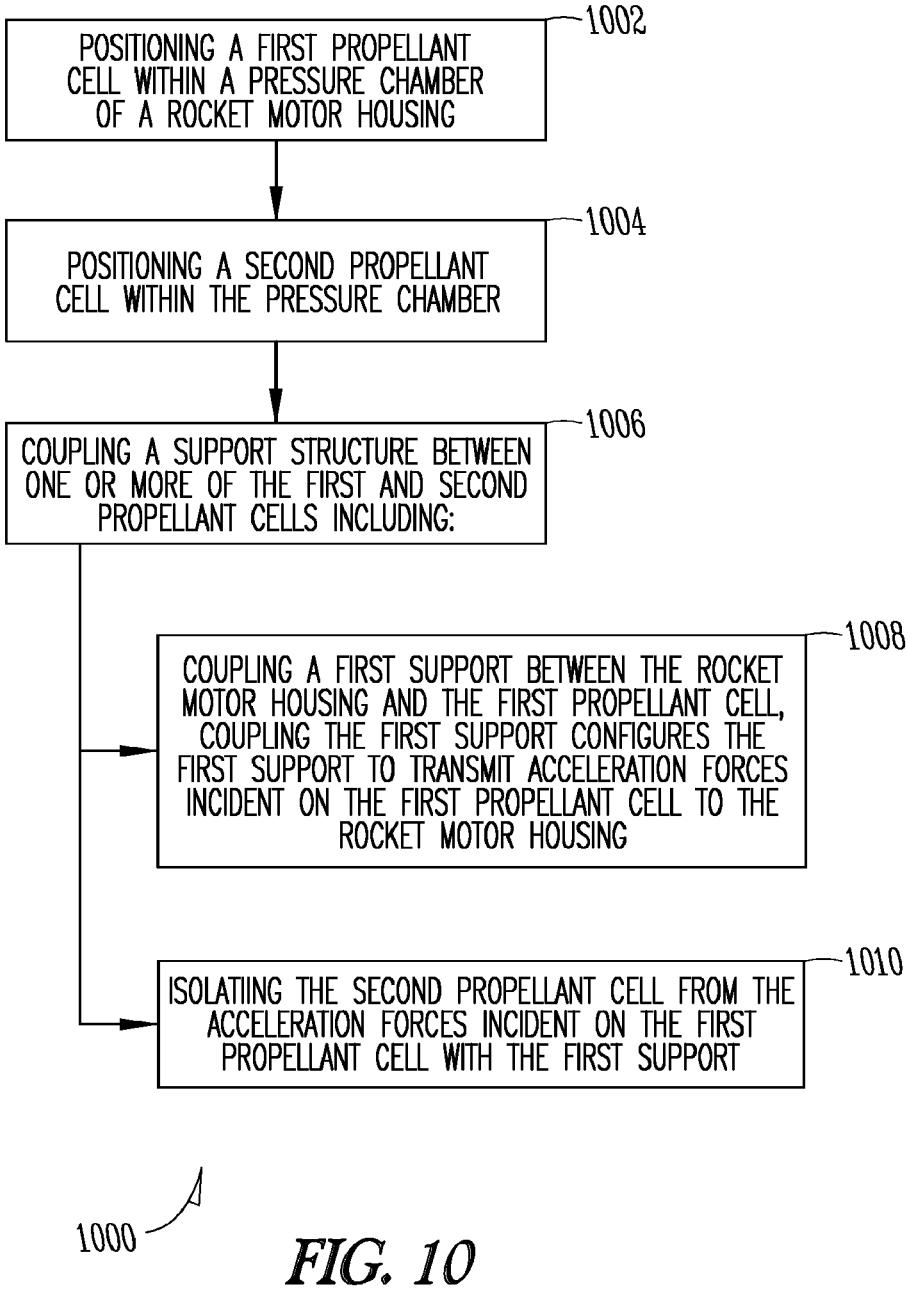
FIG. 10 is a block diagram showing one example of a method for making a gun fired propellant support assembly.

FIG. 10 shows one example of a method 1000 for making a rocket motor including a propellant support assembly for use with a gun fired projectile. The description of the method 1000 includes references to elements and features previously described herein. The references provided are intended to be exemplary and not limiting. Where reference is made to a particular element and a number is provided the corresponding element listed is not limiting and instead includes other exemplary elements herein as well as their equivalents. At 1002, the method 1000 includes positioning a first propellant cell, such as the sustaining propellant cell 320, within a pressure chamber 304 of a rocket motor housing 302. See FIGS. 3A through 3D. At 1004, a second propellant cell, such as boosting propellant cell 316, is positioned within the pressure chamber 314. For instance, the propellant cells are sequentially loaded within the rocket motor housing 302 according to the specified acceleration and range requirements of the rocket motor 300 when used with a gun fired projectile.

At 1006, a support structure, such as a support assembly including in one example one or more of support shelves 314 and supports 324 are coupled between one or more of the first and second propellant cells 316, 322. Coupling of the support structure (including, for instance, the support plates 324) includes, in one example, coupling a first support 324 between the rocket motor housing 302 and the first propellant cell 322, as shown at 1008. Coupling the first support, such as the support plate 324 configures the first support to transmit forces generated with setback acceleration incident on the first propellant cell 322 to the rocket motor housing 302 as opposed to the adjacent propellant cells including, for instance, the boosting propellant cell 316. As previously described, engaging the support 324 with the rocket motor housing 302 suspends each of the propellant cells 322, 316 relative to the other propellant cells contained with the rocket motor housing 302.

At 1010, coupling the support structure 324 between one or more of the first and second propellant cells 322, 316 includes, in another example, isolating the second propellant cell 316 from inertial forces (e.g., forces generated by setback acceleration) incident on the first propellant cell 322 with the first support 324. As shown in FIG. 3D, for instance, the support plates 324 are engaged with the corresponding support shelves 314 formed in the keyed ribs 306. Engagement of the supports 324 therein supports each of the propellant cells 322, 316 relative to the adjacent propellant cells. Suspension of the propellant cells thereby isolates each of the propellant cells from transmission of inertial forces and eliminates corresponding compression of propellant cells otherwise caused where inertial forces are transmitted through the cells. Instead the inertial forces caused by the setback acceleration are transmitted to the rocket motor housing 302. The propellant cells are thereby protected from both the acceleration forces and corresponding compression of the cells capable of causing failure of the rocket motor 300 or unpredictable ignition and burning of the propellant cells.

Several options for the method 1000 follow. In one example, coupling the first support 324 between the rocket motor housing 302 and the first propellant 322 includes coupling the first propellant cells 322 with a first support plate 324 (e.g., by bonding the first propellant cell with the first support plate). The first support plate is thereafter coupled with the rocket motor housing 302 thereby positioning the first propellant cell 322 within the pressure chamber 314 as well. In another example, the method 1000 includes coupling the first propellant cell 810 within a first support cup 814, and coupling the first support cup 814 within the rocket motor housing 802 (see FIGS. 8A-B). Optionally, the method includes engaging a second support cup 814 such as a proximally positioned support cup with the first support cup 814 as shown in FIG. 8A. The second support cup 814 is configured to transmit inertial forces (e.g., forces caused by the setback acceleration during gun firing) incident on the distal first propellant cell 810 directly to the rocket motor housing 802. The second support cup 814 and the first support cup 814 isolate the second propellant cell 810 from inertial forces incident on the distally positioned first propellant cell 810. Stated another way, the second support cup 814 receives inertial forces transmitted from the first support cup 814 and transmits that to the rocket motor housing 802 thereby isolating the proximally located boosting propellant cell 810.

In another example, coupling the first support between the rocket motor housing and the first propellant cell includes positioning a first support 626A within a graduated pressure chamber 614 as shown in FIG. 6G. The first support 626A is engaged with a first shelf 612 formed in the pressure chamber 614. As shown in FIG. 6G, in another example, the method 1000 includes linearly positioning gradually larger propellant cells 624A-F within the graduated pressure chamber 614 along with progressively larger support 626A-F therebetween. The propellant cells 624A-F and the supports 626A-F are positioned within gradually larger propellant sockets 620.

In another example, positioning the first and second propellant cells in the pressure chamber, such as the pressure chamber 716 shown in FIG. 7B includes positioning the first and second propellant cells 720, 718 in a rail magazine 726 (see FIG. 7F). The rail magazine 726 is then positioned within the pressure chamber 716 of the rocket motor 700 as shown in FIG. 7G. Optionally, coupling the support structure including the supports 722 and the rails 728 of the rail magazine 726 includes coupling the first support 722 with a rail 728 of the rail magazine. The rail 728 extends along the first and second propellant cells 720, 718. Positioning the rail magazine 726 within the pressure chamber 716 includes positioning the rail 728 out of alignment with a key rib 710 shown in FIG. 7B. Rotation of the rail magazine 726 engages the rail 728 with the key rib 710 and rotatably fixes the rail magazine 726 from further rotation relative to the rocket motor housing 702.

In still another example, the method 1000 further includes selecting a first propellant cell and selecting a second propellant cell. The first propellant cell, for instance, includes a first propellant composition such as an accelerating or boosting propellant composition different from a second propellant composition of the second propellant cell. In one example, the second propellant cell includes a sustaining propellant composition configured to maintain the velocity of the gun fired projectile including any of the rocket motors described herein.

In yet another example, coupling the first support 324 between the rocket motor housing 302 and the first propellant cell 322 (or 316) includes sliding the first support 324 along keyed ribs 306 in the rocket motor housing 302. Locking the first support 324 within the rocket motor housing includes rotating the keyed recesses on the first support 324 out of alignment with the keyed ribs 306. In another example, coupling the first support between the rocket motor housing 902 and the first propellant cell 910 (or 912) includes interposing paper such as a nitrocellulose frame or skeleton 914 between the first and second propellant cells 910, 912 as shown in FIG. 9A. Optionally, coupling the support structure 913 including the paper frame 914 between one or more of the first and second propellant cells 910, 912 includes encasing at least portions of one or more of the first and second propellant cells in paper, such as nitrocellulose. In still another option, coupling the support structure 913 between one or more of the first and second propellant cells 910, 912 includes filling a hollow center or core of at least one of the first and second propellant cells 910 with paper including a paper core 916 as shown in FIG. 9B.

The method 1000 further includes in other examples flow forming material such as metals for the rocket motor causing over a keyed mandrel such as the keyed mandrel 311 shown in FIG. 3B. The keyed mandrel 311 includes one or more key shapes 312 such as recesses extending along all or a portion of the keyed mandrel. The one or more key shapes 312 form one or more corresponding keyed ribs, such as keyed ribs 306, in the rocket motor housing 302, for instance, within the pressure chamber 304. In another example, the method 1000 further includes cutting shelves such as support shelves 314 into one or more of the keyed ribs 306. As previously described herein, the support shelves 314 provide a positive engagement with the supports 324 (e.g., support plates). Rotation of the supports 324 relative to the keyed ribs 306 moves corresponding keyed recesses 320 out of engagement with the keyed ribs 306 and thereby axially fixes each of the supports 324 relative to the rocket motor housing 302.

CONCLUSION

The support assemblies and methods described herein provide a structural support system for a plurality of propellant cells. The support assemblies are configured to suspend each of the propellant cells relative to the remainder of a plurality of propellant cells and substantially isolate each of the propellant cells from transmitting forces such as forces generate by setback acceleration to other propellant cells within the rocket motor. Instead, the support systems provided herein transmit inertial forces directly to the rocket motor housing and isolate each of the propellant cells from forces that would otherwise cause compression and possible fracture of the propellant cells. Further, by using a plurality of propellant cells within a rocket motor housing a corresponding plurality of supports are positioned between each of the propellant cells to assist in the isolation of numerous propellant cells as opposed to support of a single larger propellant cell. Compression of each of the propellant cells is thereby more easily managed because of the decreased mass of each of the propellant cells relative to a larger single propellant cell held within a rocket motor. Because the projectile including the rocket motor as described herein is accelerated up to 12,000 g's during gun firing transmission of these inertial forces to the rocket motor housing 302 is critical to the structural integrity of each of the propellant cells and the predictable firing and delivery of the projectile without failure. Phenomena including adiabatic compression of larger propellant cells and premature detonation of propellant cells because of large propellant cell mass is thereby substantially avoided. Further, fracture caused by the acceleration in the gun fired environment is minimized as well.

In another example, where one of the plurality of propellant cells includes an error such as a fracture (e.g., from manufacturing) the rocket motors described herein including the support assemblies create a much more tolerant environment for propellant cells containing such errors. Because compression forces are not transmitted through a large unitary grain but are instead transmitted into the rocket motor housing each of the propellant cells are isolated. Fractures within any of the propellant cells thereby experience correspondingly minimized compression. Unpredictable rapid burning and detonation are thereby substantially minimized and the projectile including the rocket motor is better able to follow the planned trajectory and accurately reach the target.

In another example, where the support assembly described herein is included with a plurality of propellant cells a specified void between an ignition cartridge and a propellant cell is maintained during gun firing of a projectile. As previously described above, the support structures and assemblies including the plates, cups, encasements and the like suspend each of the propellant cells relative to adjacent propellant cells. Compression forces transmitted proximally through rocket motors including the support assemblies described herein are transmitted to the rocket motor housing 302 and not transmitted to the proximally located propellant cells. Because the proximally located propellant cells are minimally compressed during firing the propellant is not compressed into the void between the propellant and the ignition cartridge. A predictable firing environment for the ignition cartridge is thereby maintained as the specified void needed for predictable ignition and burning of the ignition cartridge and the adjacent propellant cells is thereby maintained. Maintaining the void and therefore the specified volume between the propellant and ignition cartridge as designed assists in ensuring a reliable trajectory and accuracy for a projectile containing the rocket motor.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or to essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. A gun fired projectile comprising:

a rocket motor housing including a pressure chamber and an exhaust nozzle;

a plurality of propellant cells positioned within the pressure chamber, one or more of the propellant cells includes a central void; and a support structure including two or more supports:

wherein each of the two or more supports is engaged with the rocket motor housing, and at least a first support and a second support of the two or more supports are in contact, wherein at east one of the two or more supports is engaged with one propellant cell of the plurality of propellant cells, and the propellant cell is exposed within the central void, and wherein at least one of the two or more supports suspends an individual propellant cell from the remainder of the plurality of propellant cells.

2. The gun fired projectile of claim 1, wherein the two or more supports include support plates.

3. The gun fired projectile of claim 2, wherein the two or more support plates include one or more keyed recesses, and the pressure chamber includes one or more keyed ribs slidably received within the one or more keyed recesses.

4. The gun fired projectile of claim 3, wherein the keyed ribs include shelves sized and shaped to rotatably receive the support plates, and rotation of the support plates along the shelves moves the keyed recesses out of alignment with the keyed ribs.

5. The gun fired projectile of claim 3, wherein the support structure comprises a rail magazine including rails coupled with the support plates, the rails extend along the one or more propellant cells, the rails are received within the pressure chamber and engageable with the one or more keyed ribs.

6. The gun fired projectile of claim 1, wherein the rocket motor housing includes a graduated pressure chamber, the graduated pressure chamber including one or more shelves positioned along the graduated pressure Chamber, the one or more shelves are sized and shaped to engage with at least one of the two or more supports.

7. The gun fired projectile of claim 1, wherein one or more of the plurality of propellant cells each include one of the supports bonded to the propellant cells.

8. The gun fired projectile of claim 1, wherein the two or more supports includes one or more support cups, each support cup houses one of the plurality of propellant cells, and the support cups are slidably received within the pressure chamber.

9. The gun fired projectile of claim 1, wherein the two or more supports includes one or more bases, each base engaged with one of the plurality of propellant cells.

10. The gun fired projectile of claim 9, wherein one or more sidewalk extend from each of the one or more bases, each of the one or more sidewalls surrounds one of the plurality of propellant cells, and the one or more sidewalls and respective one or more bases form one or more support cups.

11. The gun fired projectile of claim 9, wherein each of the one or more bases includes a support passage extending therethrough.

12. The gun fired projectile of claim 1, wherein a sidewall of a second support of the two or more supports extends along a length of an outer perimeter of a second propellant cell of the one or more propellant cells to engage with a first support of the two or more supports.

13. A gun fired projectile comprising:

a rocket motor housing including a pressure chamber and an exhaust nozzle;

a first propellant cell positioned within the pressure chamber;

a second propellant cell positioned within the pressure chamber adjacent to the exhaust nozzle; and a support structure including:

a first support engaged with the rocket motor housing, the first support carries the first propellant cell, and the first support separates the first propellant cell from the second propellant cell, a second support engaged with the rocket motor housing, the second support carries the second propellant cell, and the first support is in contact with the second support, wherein acceleration forces incident on the first propellant cell are transmitted through the first support and the second motor support to the rocket motor housing, and Wherein the acceleration forces incident on the second propellant cell are transmitted to the rocket motor housing separate from the first propellant cell.

14. The gun fired projectile of claim 13, wherein the acceleration forces incident on the second propellant cell are transmitted through the second support to the rocket motor housing.

15. The gun fired projectile of claim 13 comprising:

a third propellant cell positioned within the pressure chamber distal relative to the exhaust nozzle and the first and second propellant cells;

a third support engaged with the rocket motor housing, the third support carries the third propellant cell, and the third support separates the third propellant cell from the first and second propellant cells; and the acceleration forces incident on the third propellant cell are transmitted through the third support to the rocket motor housing.

16. The gun fired projectile of claim 13, wherein the first support isolates the second propellant cell from compression forces incident on the first propellant cell.

17. The gun fired projectile of claim 13, wherein the first support includes one or more keyed recesses, and the pressure chamber includes one or more keyed ribs, the keyed ribs are received within the keyed recesses of the first support, and the first support is rotatably fixed to the rocket motor housing.

18. The gun fired projectile of claim 17, wherein the support structure includes a rail magazine including rails coupled with a plurality of supports including the first support, the rails extend along the first and second propellant cells, the rails are engaged with the keyed ribs, and the rail magazine and first and second propellant cells are rotatably fixed to the rocket motor housing.

19. The gun fired projectile of claim 13, wherein first support is bonded with the first propellant cell.

20. The gun fired projectile of claim 13, wherein the support structure includes a paper encasement extending around and between the first and second propellant cells.

21. The gun fired projectile of claim 13, wherein the first support includes a base engaged with the first propellant cell.

22. The gun fired projectile of claim 21, wherein a sidewall extends from the base, the sidewall surrounds the first propellant cell, and the sidewall and the base form a support cup.

23. The gun fired projectile of claim 21, wherein the base includes a support passage extending therethrough.

24. The gun fired projectile of claim 13, wherein a sidewall of the second support extends along a length of an outer perimeter of the second propellant cell to engage with the first support.

25. The gun fired projectile of claim 13, Wherein at least one of the first or second propellant cells includes a central void, and the respective first or second support carrying the first or second propellant cell is recessed from the central void.

26. A gun fired projectile comprising:

a rocket motor housing configured for firing from a gun, the rocket motor housing including a pressure chamber and an exhaust nozzle;

a plurality of propellant cells positioned linearly in series within the pressure chamber; and a support structure including two or more supports, the two or more supports mechanically isolate the plurality of propellant cells from each other:

wherein each of the two or more supports is coupled with the rocket motor housing, and each of the two or more supports is linearly contacting at least one adjacent support of the two or more supports, wherein each of the one or more supports surrounds one propellant cell of the plurality of propellant cells, and wherein each of the two or more supports suspends an individual propellant cell from the remainder of the plurality of propellant cells according to linear contact of each of the two or more supports with at least one adjacent support of the two or more supports.

27. The gun fired projectile of claim 26, wherein acceleration forces incident on a first propellant cell of the plurality of propellant cells are entirely transmitted through the two or more supports to the rocket motor housing, and wherein acceleration forces incident on a second propellant cell of the plurality of propellant cells are entirely transmitted through the two or more supports to the rocket motor housing.

28. The gun fired projectile of claim 26, wherein the two or more supports are each bonded, respectively, to one of the plurality of propellant cells.

29. The gun fired projectile of claim 26, wherein the two or more supports includes two or more support cups, each support cup houses one of the plurality of propellant cells, and the support cups are slidably received within the pressure chamber.

30. The gun fired projectile of claim 29, Wherein each of the two or more support cups includes a sidewall, and the sidewalls of the two or more support cups linearly contact at least one adjacent sidewall of the two or more support cups.

31. The gun fired projectile of claim 26, wherein a sidewall of the second support extends along a length of an outer perimeter of the second propellant cell to engage with the first support.

32. The gun fired projectile of claim 26, wherein at least one of the plurality of propellant cells includes a central void, and the respective support of the two or more supports surrounding the propellant cell having the central void is recessed from the central void.

* * * * *

UNITED STATES PATENT AND TRADEMARK OFFICE

CERTIFICATE OF CORRECTION

PATENT NO. : 8,453,572 B2
APPLICATION NO. : 12/836954
DATED : June 4, 2013
INVENTOR(S) : Dryer et al.

It is certified that error appears in the above-identified patent and that said Letters Patent is hereby corrected as shown below:

In the Drawings:

On Sheet 7 of 12, reference numeral 622, insert --FIG. 6F--, therefor

On Sheet 7 of 12, Fig. 6H, reference numeral 629, delete "629" and insert --628--, therefor In the Specification:

In column 1, line 57, after "view", insert --of--, therefor

In column 4, line 61, delete "320" and insert --322--, therefor

In column 5, line 29, delete "320" and insert --322--, therefor

In column 5, line 30, delete "320" and insert --322--, therefor

In column 5, line 32, delete "320" and insert --322--, therefor

In column 5, line 36, delete "320" and insert --322--, therefor

In column 5, line 39, delete "320" and insert --322--, therefor

In column 5, line 45, delete "320" and insert --322--, therefor

In column 5, line 49, delete "320" and insert --322--, therefor

In column 5, line 52, delete "320" and insert --322--, therefor

In column 5, line 58, delete "320" and insert --322--, therefor

In column 5, line 61, delete "320" and insert --322--, therefor

Signed and Sealed this
Twenty-fourth Day of September, 2013

Teresa Stanek Rea

Teresa Stanek Rea
*Deputy Director of the United States Patent and Trademark Office*

In column 5, line 67, delete “320” and insert --322--, therefor

In column 6, line 2, delete “320” and insert --322--, therefor

In column 6, line 7, delete “320” and insert --322--, therefor

In column 6, line 36, delete “$F_i$” and insert --$F_I$--, therefor

In column 6, line 37, delete “$F_i$” and insert --$F_I$--, therefor

In column 7, line 2, delete “401” and insert --410--, therefor

In column 7, line 6, delete “$F_{11}$” and insert --$F_{I1}$--, therefor

In column 7, line 6, delete “$F_{12}$” and insert --$F_{I2}$--, therefor

In column 7, line 7, delete “$F_{11}$” and insert --$F_{I1}$--, therefor

In column 7, line 12, delete “$F_{11}$” and insert --$F_{I1}$--, therefor

In column 7, line 14, delete “$F_{12}$” and insert --$F_{I2}$--, therefor

In column 7, line 17, delete “$F_{12}$” and insert --$F_{I2}$--, therefor

In column 7, line 20, delete “$F_{12}$” and insert --$F_{I2}$--, therefor

In column 7, line 22, delete “$F_{12}$” and insert --$F_{I2}$--, therefor

In column 7, line 28, delete “$F_{12}$” and insert --$F_{I2}$--, therefor

In column 7, line 28, delete “$F_1$” and insert --$F_I$--, therefor

In column 8, line 4, delete “320” and insert --322--, therefor

In column 11, line 11, after “and”, delete “14”, therefor

In column 11, line 43, after “such”, insert --as--, therefor

In column 12, line 42, after “distal”, insert --end--, therefor

In column 13, line 47, delete “919” and insert --910--, therefor

In column 14, line 25, delete “320” and insert --322--, therefor

In column 14, line 29, delete “314” and insert --304--, therefor

In column 15, line 10, delete “314” and insert --304--, therefor

In column 16, line 46, delete “generate” and insert --generated--, therefor

In column 17, line 64, after “or”, delete “to”, therefor

In the Claims:

In column 18, line 43, in claim 1, delete “east” and insert --least--, therefor

In column 19, line 2, in claim 6, delete “Chamber” and insert --chamber--, therefor In column 19, line 18, in claim 10, delete “sidewalk” and insert --sidewall--, therefor In column 19, line 50, in claim 13, delete “Wherein” and insert --wherein--, therefor In column 19, line 57, in claim 15, delete “13” and insert --13,--, therefor In column 20, line 16, in claim 19, after “wherein”, insert --the--, therefor In column 20, line 32, in claim 25, delete “Wherein” and insert --wherein--, therefor In column 21, line 6, in claim 30, delete “Wherein” and insert --wherein--, therefor